United States Patent [19]

Gierse

[11] 4,223,634

[45] Sep. 23, 1980

[54] DEVICE FOR THE APPLYING OF MELTED OR LIQUID DYES FOR THE INKING OF CUTTING EDGES

[76] Inventor: Heinz Gierse, Taunusstr. 33, 5 Koln 91, Fed. Rep. of Germany

[21] Appl. No.: 744,150

[22] Filed: Nov. 22, 1976

[30] Foreign Application Priority Data

Nov. 22, 1975 [DE] Fed. Rep. of Germany ..... 2552390

[51] Int. Cl.[2] ..... B05C 1/02; F04B 23/00

[52] U.S. Cl. ..... 118/401; 118/202; 417/441

[58] Field of Search ..... 417/441, 470, 540; 118/5, 50, 202, 401, 267, 50.1

[56] References Cited

U.S. PATENT DOCUMENTS

| | | | |
|---|---|---|---|
| 1,327,272 | 1/1920 | Dellgren | 417/441 |
| 1,729,056 | 9/1929 | Texier | 118/50 |
| 2,283,193 | 5/1942 | Dixon | 118/401 |
| 2,753,804 | 7/1956 | Goss | 417/441 X |
| 3,136,265 | 6/1964 | Chenault | 417/441 |
| 3,216,650 | 11/1965 | Thyreen | 417/441 X |
| 3,522,836 | 8/1970 | King | 118/401 X |

*Primary Examiner*—W. C. Reynolds
*Attorney, Agent, or Firm*—Robert T. Gammons

[57] ABSTRACT

A marking device wherein liquid is dispensed through the interfacial spaces in a bank of thin blades to an article pressed into engagement with the lower ends of the blades and wherein the flow of liquid to the blades is controlled by maintaining a vacuum in the storage tank which supplies the liquid to the blades characterized in the combination therewith of improved vacuum-producing means by means of which the vacuum of constant predetermined pressure can be maintained with a lesser volume transfer and, hence, with less evaporation of the liquid material, with less work output and, hence, less noise output, and with improved longevity of the apparatus.

2 Claims, 1 Drawing Figure

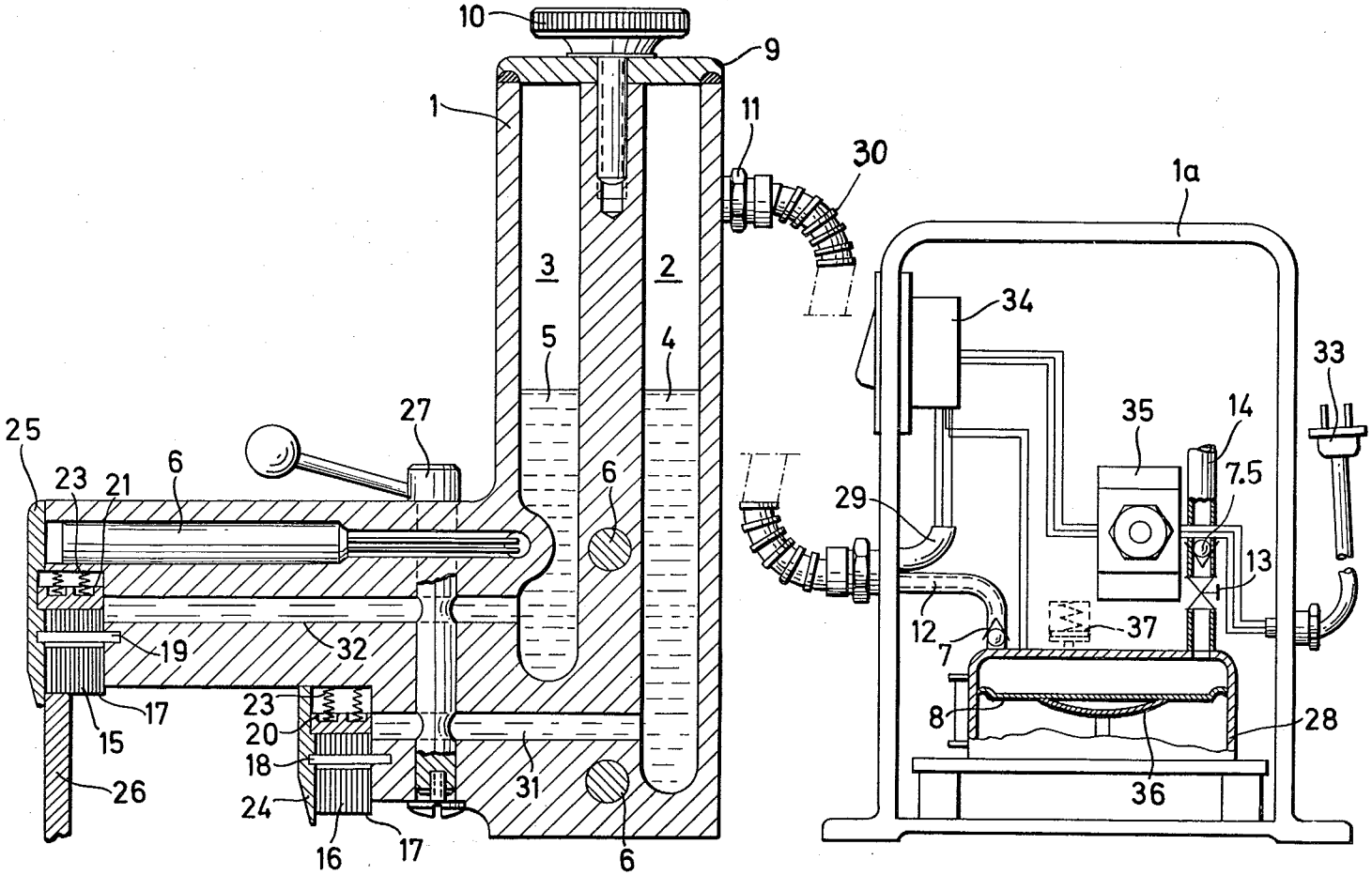
33
28
1a
14
7.5
13
35
37
36
34
12
7
8
29
30
9
11
2
4
6
6
3
5
31
10
1
27
17
32
16
23
20
18
24
6
19
17
21
15
26
23
25

DEVICE FOR THE APPLYING OF MELTED OR LIQUID DYES FOR THE INKING OF CUTTING EDGES

The invention relates to a device for the applying of melted or liquid dyes for the inking of cut edges on leathergoods or artificial leathergoods with a storage tank for the dye that is connected with a vacuum pump which constantly generates a controllable negative pressure and that is connected with an inking port covered by lamellas between which the dye emerges.

A device of the aforesaid kind is disclosed in my copending U.S. application Ser. No. 598,011, filed July 22, 1975, now U.S. Pat. No. 4,038,940, entitled DEVICE FOR THE APPLICATION OF MELTABLE OR LIQUID COLORS. In the device disclosed in the aforesaid application, the negative pressure is controlled by means of an adjustable choke through which more or less air may enter into the storage tank. For a satisfactory regulation the vacuum pump has to deliver a larger volumetric displacement than would be needed merely to compensate for leakages. This entails a greater output and noise, which is undesirable particularly if the device is to be used for long periods of time.

The present invention has for its objective to reduce the vacuum pump output and the development of noise. This is achieved by employing a vacuum pump of the piston pump or diaphragm pump type at whose delivery side is arranged an adjustable choke.

Because of the design in accordance with the invention, the vacuum pump has only to compensate for the leakage losses to maintain the desired negative pressure so that only negligible air flow takes place with very little noise. Because the choke is situated at the delivery side also the pump noise is reduced. The regulation of the negative pressure is achieved through reduction of the volumetric displacement by means of changes in the aperture of the choke. The smaller the choke opening, the smaller becomes with increased counterpressure the effective stroke of the piston or the diaphragm.

In the development of the invention it is beneficial to actuate the piston or the diaphragm through an elastic element. The stroke is thus varied in dependence on the counterpressure and thereby on the size of the choke aperture in sympathy with the choke aperture. For the same purpose, a storage piston may be arranged at the delivery side of the vacuum pump in lieu of the elastic elements.

In the drawing is represented an example of an embodiment of the invention.

The illustration shows a partial longitudinal section of a device in accordance with the invention.

The device consists of two housing parts 1 and 1*a*. In the housing part 1 are provided two storage chambers 2 and 3 for different colors 4 and 5, which are heated and melted through heating elements 6. The heating elements 6 are regulated by a thermostat in such a manner that the colors 4 and 5 have a constant temperature. The storage chambers 2,3 are interconnected above the color melt through recesses 2.2 in the dividing wall 3.2 so that the same pressure prevails in both storage chambers 2,3. Further, the storage chambers 2,3 are tightly closed off through a cover 9 and a central knurled-head screw 10.

In order to generate a negative pressure in the storage chambers 2,3 above the colors 4,5 there is arranged in this region a connection 11 for a vacuum pump 28, which is accommodated, thermally insulated, in the housing part 1*a*. The suction pipe 12, in which is arranged as check valve 7, as well as the electric cable 29 are encased in a common protective pipe 30.

The negative pressure in the storage chamber 2,3 is set by means of a controllable choke 13 in a pressure line 14 of the vacuum pump 28. The pressure line 14 contains in addition to the controllable choke 13, a check valve 7.5 like the check valve 7 in the line 12. Both of these check valves 7 and 7.5 are of conventional design and readily available items of commerce. Depending on the position of choke 13 there results more or less strong counterpressure, through which changes the volumetric displacement of pump 28 which is constructed as a diaphragm pump. Another pressure-dependent change of the volumetric displacement is accomplished by actuation of the diaphragm 8 through a spring element 36.

With increasing counterpressure a part of the stroke is taken up by the spring element 36. A comparable effect may be had with a storage piston 37 (drawn in dash-lines), which takes up on increasing counterpressure a part of the volumetric displacement and gives it off again on the suction stroke. Through this the effective volumetric displacement of the pump is likewise reduced.

With the aid of the negative pressure and of the temperature control the amount of color can be fixed that can be taken off at the dosing orifice 15,16 and applied to a workpiece.

At a constant temperature, an increase in the negative pressure decreases the flow of the color.

The dosing orifices 15,16 are constantly open while the device is in operation. They are formed by the gaps between several lamellas 17, which are supported with play on bolts 18,19 which are brought to abut through contact pieces 20,21 of heat-resistant material by springs 23. It is also possible to have the lamellas yieldingly supported individually or in groups.

The bolts 18, 19, in turn, are supported in the housing 1 and in the detachable cover plates 24,25 arranged parallel to the lamellas 17. These cover plates serve at the same time as guide rail for the workpiece 26.

The device, which is more particularly meant for the inking of cut edges, can also be used for other purposes, e.g. the inking of decorative lines or the like. The width of the lines can hereby be determined by the number of lamellas 17. Further, instead of wax colors, also powdery plastic colors can be used. To be able to stop the vacuum pump also before the color congeals without that the colors 4,5 dribble down there is provided in the dye ducts 31,32 a common cock 27.

The supply of current, that is cut in through a switch 34, takes place through a feed line 33. For the protection of the device there are provided fuses 35.

I claim:

1. A marking device comprising in combination a storage tank for holding a quantity of liquid material, means yieldably mounting a plurality of lamella at the lower end of the storage tank for receiving said liquid material from the tank, said lamella being operable by displacement when a workpiece is placed in engagement therewith to dispense liquid onto the workpiece, and vacuum-producing means for maintaining a constant vacuum within the storage tank with minimum volume flow, said vacuum-producing means comprising a pump chamber having inlet and outlet ports at one end of the pump chamber, first conductor means connecting the inlet port to the storage tank, second conductor means connecting the outlet port to the atmosphere, inlet and outlet check valves in said conductor means so arranged that when one is opened, the other is closed, a part in the pump chamber spaced from the one end and movable in one direction to induce air flow from the storage tank through the inlet valve into the pump chamber and in the other direction to discharge the air induced into the pump chamber from the storage chamber through the outlet valve from the pump chamber to the atmosphere, reciprocably movable power-operable means for effecting reciprocation of said part on the one hand to reduce the pressure between it and said one end of the pump chamber and on the other hand to increase the pressure between it and said one end of the pump chamber, and spring means yieldably connecting said part to said power-operable means, said spring means resisting relative movement between the part and the power-operable means in proportion to the change in pressure developed between the part and said one end of the chamber.

2. A marking device according to claim 1 wherein there is an adjustable choke valve in the second conductor means between the outlet port of the pump chamber and the check valve.

* * * * *